US007249430B2

(12) United States Patent
Kerker et al.

(10) Patent No.: US 7,249,430 B2
(45) Date of Patent: Jul. 31, 2007

(54) FRAMELESS DISPLAY FIXTURE

(75) Inventors: Michael Kerker, Metamora, IL (US); Brian Wegstein, Washburn, IL (US); Philip Davis, East Peoria, IL (US); Craig Cayce, Kansas City, MO (US); John Vandyke Stram, Independence, MO (US)

(73) Assignee: Hallmark Cards, Incorporated, Kansas City, MO (US)

( * ) Notice: Subject to any disclaimer, the term of this patent is extended or adjusted under 35 U.S.C. 154(b) by 303 days.

(21) Appl. No.: 10/368,265

(22) Filed: Feb. 18, 2003

(65) Prior Publication Data

US 2004/0055187 A1 Mar. 25, 2004

Related U.S. Application Data

(60) Provisional application No. 60/412,610, filed on Sep. 20, 2002.

(51) Int. Cl.
*G09F 1/10* (2006.01)

(52) U.S. Cl. ..... 40/124; 40/124.4; 211/45; 211/128.1

(58) Field of Classification Search ..... 40/124.4, 40/124; 211/55, 45, 128.1, 40; D6/473; D19/91

See application file for complete search history.

(56) References Cited

U.S. PATENT DOCUMENTS

| | | | | |
|---|---|---|---|---|
| 1,449,045 | A | | 3/1923 | Hollander |
| 2,002,128 | A | | 5/1935 | Reidenbaugh |
| 2,251,814 | A | | 8/1941 | Yohns |
| 2,292,932 | A | | 8/1942 | Edwards |
| 2,368,909 | A | | 2/1945 | Wright |
| 2,664,206 | A | * | 12/1953 | Beal ..... 211/55 |
| 3,179,479 | A | * | 4/1965 | Freedman ..... 312/140.3 |
| 3,198,340 | A | | 8/1965 | Tokash |
| 3,486,634 | A | * | 12/1969 | Frater ..... 211/128.1 |
| 3,816,948 | A | | 6/1974 | Mooney et al. |
| 3,908,830 | A | * | 9/1975 | Skrzelowski ..... 211/55 |
| 4,460,097 | A | * | 7/1984 | Darnell et al. ..... 211/189 |
| 4,613,047 | A | | 9/1986 | Bushyhead et al. |
| 4,621,878 | A | | 11/1986 | Johnson et al. |
| 4,630,731 | A | | 12/1986 | Albery |
| 4,651,872 | A | | 3/1987 | Joyce |
| 4,875,590 | A | | 10/1989 | Martin et al. |
| 4,905,845 | A | * | 3/1990 | Broeker et al. ..... 211/55 |
| 4,949,849 | A | * | 8/1990 | Hardy ..... 211/55 |
| 5,009,335 | A | | 4/1991 | Jonker |
| 5,014,859 | A | | 5/1991 | Johnson |

(Continued)

OTHER PUBLICATIONS

Harbor Industries fixture, believed to be publicly used before Feb. 18, 2003 (2 color images).

*Primary Examiner*—Cassandra Davis
(74) *Attorney, Agent, or Firm*—Fish & Richardson P.C.

(57) ABSTRACT

A display apparatus can include a substantially self-supporting panel adapted to be erected and used without the use of a support frame. In one embodiment, a frameless display fixture includes first and second panels fastened to one another proximal their upper edges, recesses adapted to receive retail merchandise integrally formed along a front side of the panel, and mating portions proximal their lower edge which interlock with a substantially rigid base unit such that the lower edges of the panels are held a fixed distance from one another. The first and second panels may be substantially mutually self-supporting so as to form a frameless display fixture.

28 Claims, 11 Drawing Sheets

U.S. PATENT DOCUMENTS

| | | | | |
|---|---|---|---|---|
| 5,040,688 | A | | 8/1991 | Martin et al. |
| D332,883 | S | | 2/1993 | Staude |
| 5,284,256 | A | | 2/1994 | Correll-Antoun |
| 5,289,926 | A | | 3/1994 | Lewis et al. |
| 5,447,242 | A | | 9/1995 | Kelly et al. |
| D390,728 | S | | 2/1998 | Herman et al. |
| 5,720,396 | A | | 2/1998 | Wegscheid et al. |
| D395,563 | S | | 6/1998 | Hamilton, III |
| 5,915,571 | A | * | 6/1999 | Czalkiewicz et al. ..... 211/55 |
| 5,921,404 | A | * | 7/1999 | Cooke et al. ..... 211/40 |
| 6,164,461 | A | | 12/2000 | Ward et al. |
| 6,167,644 | B1 | | 1/2001 | Fox |
| 2002/0088765 | A1 | * | 7/2002 | Waldron ..... 211/128.1 |

* cited by examiner

FRAMELESS DISPLAY FIXTURE

CROSS REFERENCE TO RELATED APPLICATION

This application claims priority from U.S. Provisional Application No. 60/412,610, filed Sep. 20, 2002 and entitled "Display Structure," which is incorporated by reference in its entirety.

TECHNICAL FIELD

The invention relates to display fixtures and, more particularly, certain embodiments relate to frameless display fixtures for greeting cards.

BACKGROUND

Conventional display fixtures for greeting cards or other similar products are often shipped to retail stores and assembled on-site. The individuals who actually assemble the display fixtures may not be mechanically skilled, and the chore of assembling the fixtures can be time consuming. While simplicity of assembly and weight reduction are significant factors in the design of display fixtures, those features can often be improved only at the cost of achieve structural integrity. After the display fixture is assembled, the strength and balance of the fixture are usually tested by inadvertent abuse from customers, shopping carts, floor-cleaning machines, and other various loads placed upon the fixture. Because display fixtures must be able to withstand such treatment, conventional display fixtures are comparatively heavy, cumbersome, and typically include many component parts and fasteners.

Conventional display fixtures generally include panels that are attached to an internal support frame. The panels, by themselves, are usually not designed to withstand the necessary loads or be self-supporting. The underlying support frame is often made from wood or metal and is positioned between the backsides of two opposing panels (while the front side of each panel is used to display products). On-wall display fixtures often include internal support frames positioned between the backside of the panel and the wall. In either case, the support frame is secured to the floor or nearby wall, and each panel relies on that frame for structural stability.

The support frames themselves add weight and complexity to the assembly. They are generally heavy and attaching panels to the support frame typically requires drilling, screwing, bolting, or other mechanical fixation. Consequently, on-site construction of these prior art display fixtures may require several hours.

Manufacturing and packaging the support frame and the parts necessary to assemble the fixture add to the total cost of the display fixture. Furthermore, because the display fixtures are often shipped to the retail store in an unassembled state (for later on site assembly), the excess weight and a space occupied by the support frame increases the transportation and assembly cost.

SUMMARY

A display apparatus can include a substantially self-supporting panel adapted to be erected and used without the use of a support frame. In one embodiment, a frameless display fixture includes first and second panels fastened to one another proximal their upper edges, recesses adapted to receive retail merchandise integrally formed along a front side of the panel, and mating portions proximal their lower edge which interlock with a substantially rigid base unit such that the lower edges of the panels are held a fixed distance from one another. The first and second panels may be substantially mutually self-supporting so as to form a frameless display fixture.

The details of one or more embodiments are set forth in the accompanying drawings and the description below. Other features, objects, and advantages of the invention will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
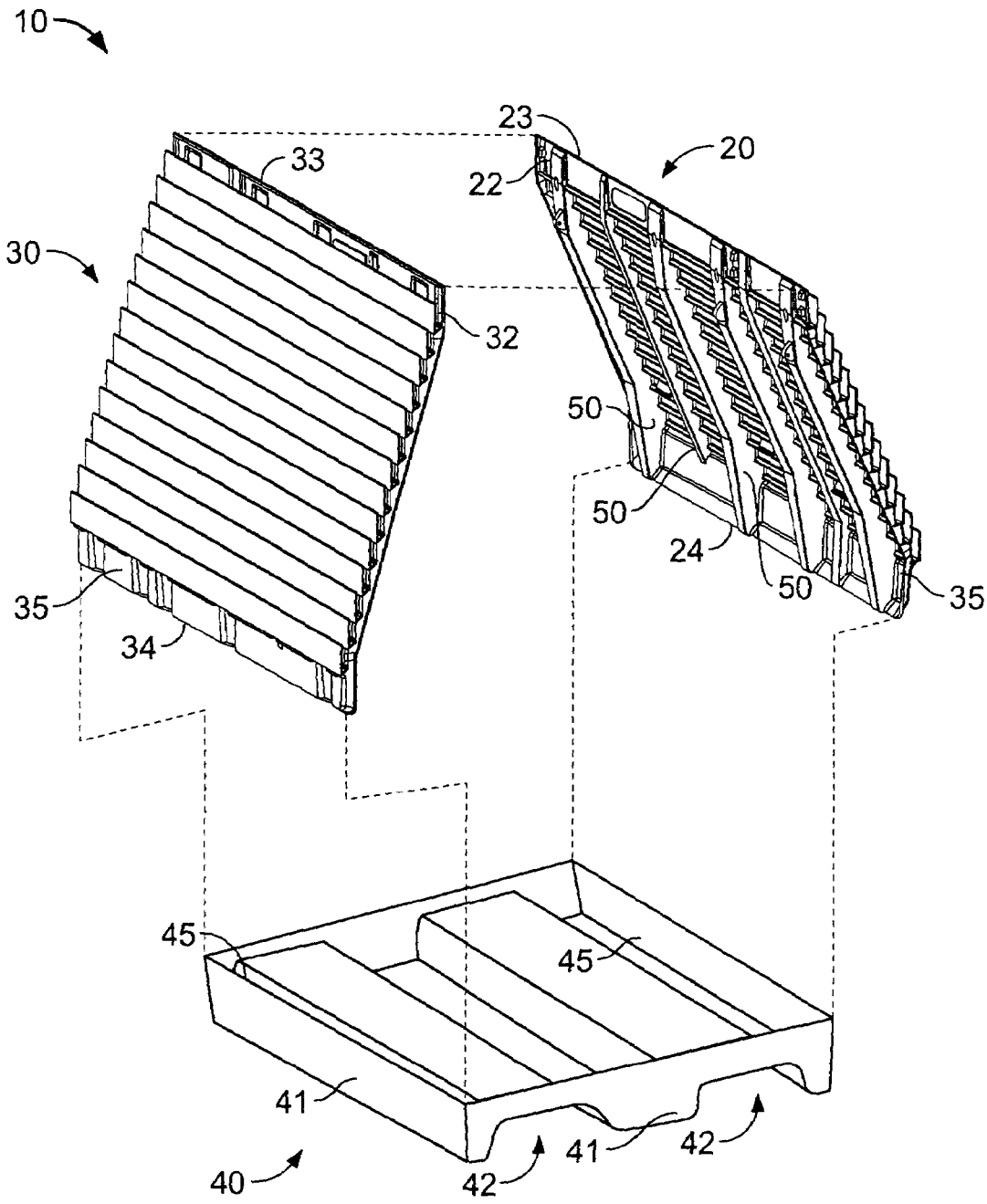
FIG. 1 is an exploded view of a display apparatus according to an embodiment of the invention.
Figure 2:
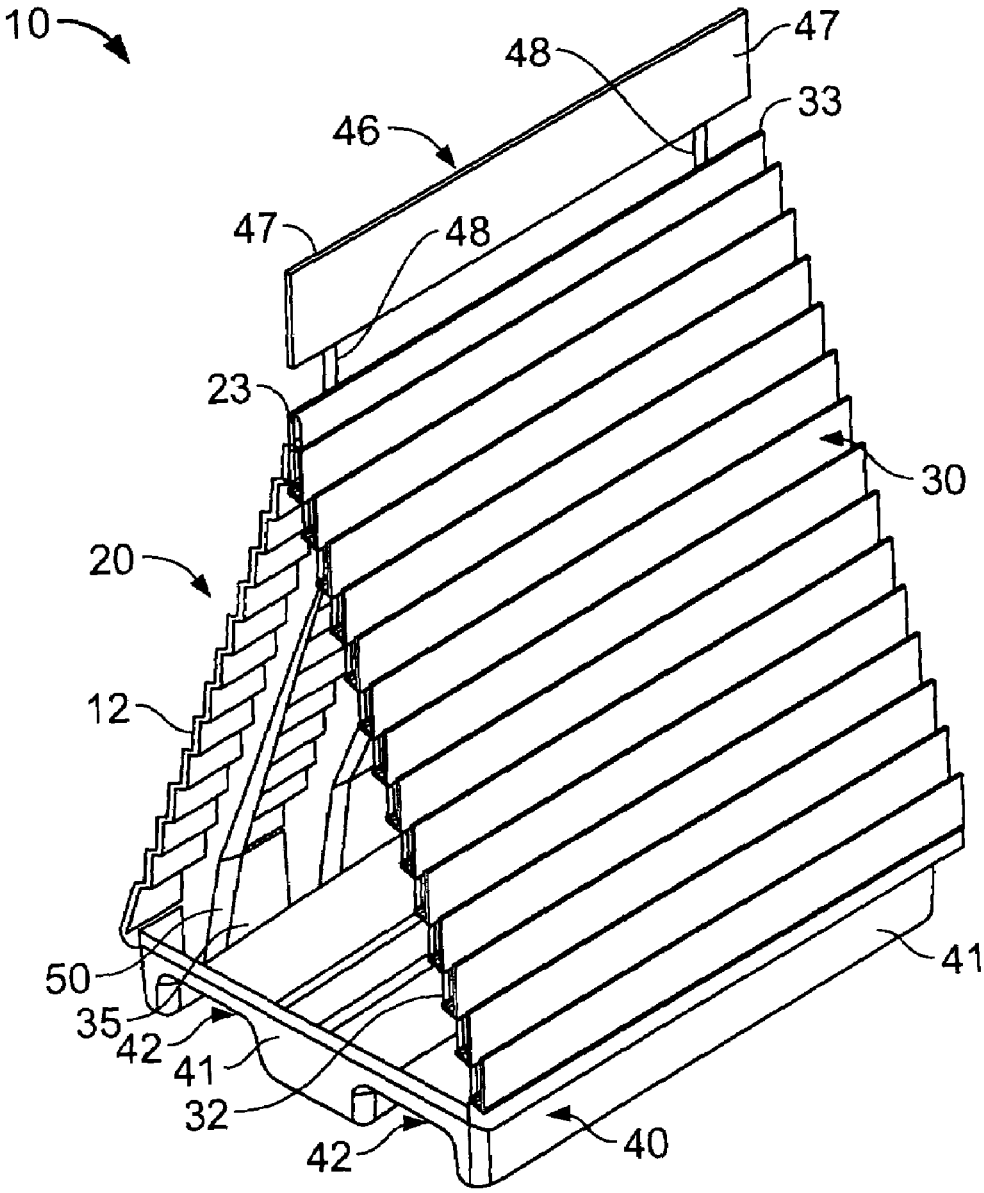
FIG. 2 is a perspective view of the display apparatus from FIG. 1.

In one embodiment, a display fixture is provided that includes a plurality of display panels in contact with and retained by a base. An exemplary fixture 10 is depicted in FIGS. 1 and 2. As shown in FIGS. 1 and 2, two display panels 20 and 30 contact one another at or near their upper ends 23 and 33. The back sides 22 and 32 of the panels 20 and 30 may be fastened to one another near the upper ends 23 and 33. The panels 20 and 30 contact a base 40 at or near their lower ends 24 and 34. The base 40 may have a substantially rigid structure and is adapted to retain the lower ends 24 and 34 of the panels 20 and 30 at a fixed distance from one another. The base 40 may be formed as an integral tub-like structure that includes generally vertical sidewalls 41 and a plurality of upwardly projecting recesses 42. The recesses 42 or similarly disposed cut-outs can serve as receptacles for various structures such as storage drawers (described in more detail below). Each display panel 20 and 30 preferably includes extensions 35 that can be interlocked to, mated with, or retained by base 40. For example, the extensions 35 may contact and mate with the inner surfaces 45 of the walls of the base 40. Alternatively or additionally, the panels can include downwardly projecting tabs that can be inserted into slots or other receptacles formed in the base 40 (as shown, for example, in FIGS. 9 and 10). The display panels may be affixed to the base or to each other by a variety of mechanical connectors, such as elbows, screws and nuts, adhesive, pin connectors, or combinations thereof.

As shown in FIG. 2, the display fixture 10 may optionally be fitted with a placard 46 attached at or near the upper ends 23 and 33 of the panels 20 and 30. The placard 46 may be may constructed of a lightweight material such as plastic and attached to the display fixture 10 using attachment rails 48 that are fastened to or fit between the upper ends 23 and 33. The placard 46 may have substantially planar surfaces 47 that are configured to hold signs or other similar materials to identify the type of products on the display fixture 10.

Figure 3:
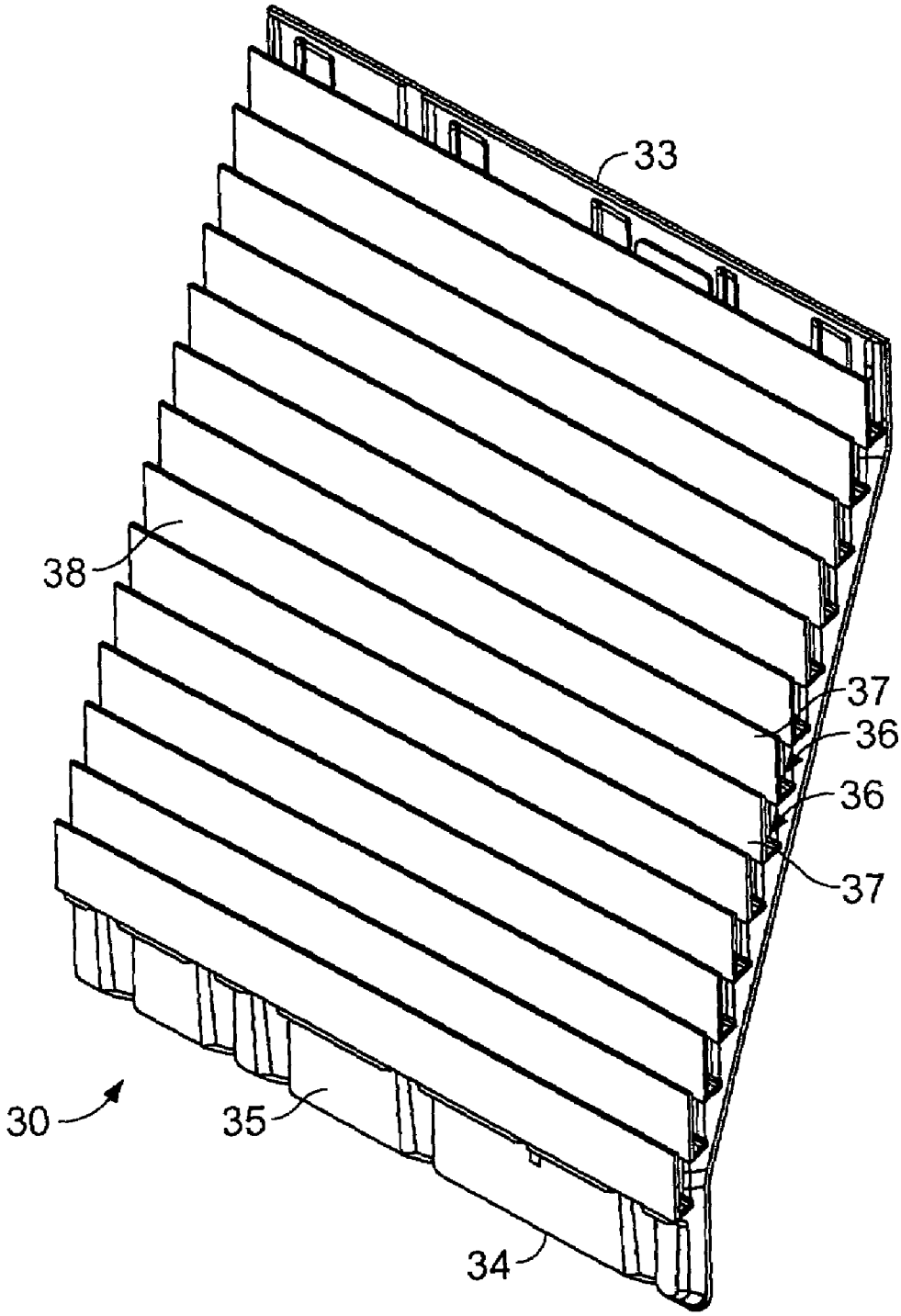
FIG. 3 is a frontal perspective view of a display panel in accordance with one embodiment of the invention.

FIG. 3 illustrates the front view of an embodiment of a panel 30. As seen in the figure, panel 30 includes recesses 36 integrally formed along the front side 38 of the panel 30. The recesses 36 may be substantially horizontal and parallel to one another. Recesses 36 may be spaced equally or, to accommodate items of various sizes, deeper, larger, or more widely spaced recesses can be used. In accordance with one embodiment, the recesses 36 may form a cascading-steps pattern, as shown in FIG. 3. The number of recesses 36 on a panel 30 may vary, depending on the desired size of the display articles. Upwardly protruding panels 37 may be attached proximate to the recesses 36 to provide a partial wall for receiving and containing display items, such as greeting cards. The protruding panels 37 may optionally be made of transparent or translucent plastic to permit the displayed items to be more readily viewed. Alternatively, protruding panels 37 may be integrally formed into the panel 30. For example, a recess 36 may be "U" shape cavities that are adapted to hold display items.

Figure 4:
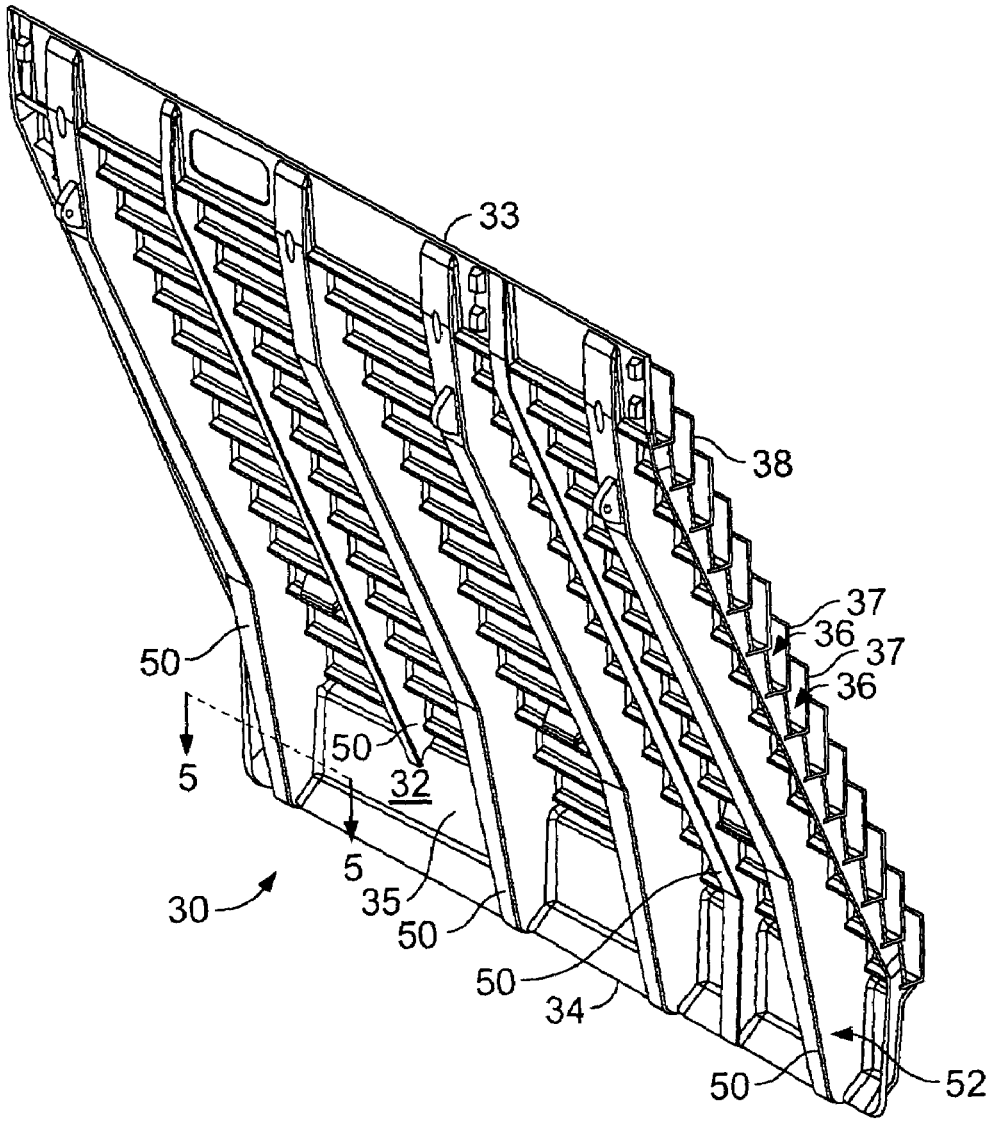
FIG. 4 is a perspective view of the back of the display panel of FIG. 3.

The rear of panel 30 is shown in FIG. 4. Panel 30 may include supports 50 that are integrally formed along the back side 32 to enhance the rigidity of the panel 30. In the embodiment shown in FIG. 4, the supports 50 may be integrally formed ribs that extend in a substantially vertical direction between the upper end 33 and the lower end 34. As shown in FIG. 4, the supports 50 may fully extend from the upper end 33 to the lower end 34. A lower portion 52 of one or more supports 50 (but not necessarily all supports 50) may form the mating extension 35 adapted to be retained by the base 40. As best shown in FIG. 2, the display panels 20 and 30 and the base 40 may be assembled to form a display fixture 10 with no internal load-bearing member (e.g. a frame). The rib supports provide rigidity to the panels 20 and 30 so that the panels 20 and 30 are substantially mutually self-supporting. By eliminating the internal load-bearing member and enhancing the strength of the outer load-bearing panels, the inventive display fixture has a monocoque construction.

Figure 5:
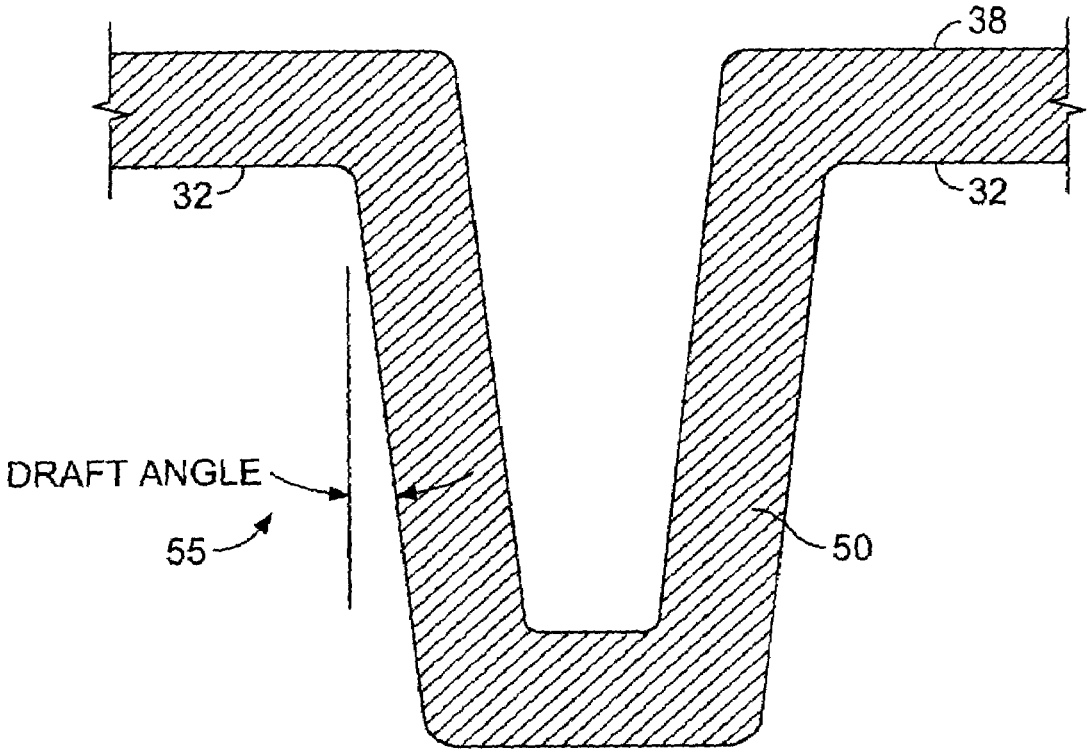
FIG. 5 is a cross-sectional view of a portion of the display panel of FIG. 4 in accordance with one embodiment of the invention

FIG. 5 shows a cross-section of one embodiment of the rib supports 50 from FIG. 4. The rib supports are integrally formed along the back side 32 of the panel 30 with a draft angle 55 of about 1° to 20°. In particular, a draft angle of about 3° to about 10° is preferable, and in certain embodiments about 4° to about 8°. The draft angle 55 of the rib supports 50 may facilitate removal from the mold during manufacturing and may permit the panels to be nested together in a stack, which in turn facilitates packaging and shipment.

Figure 6:
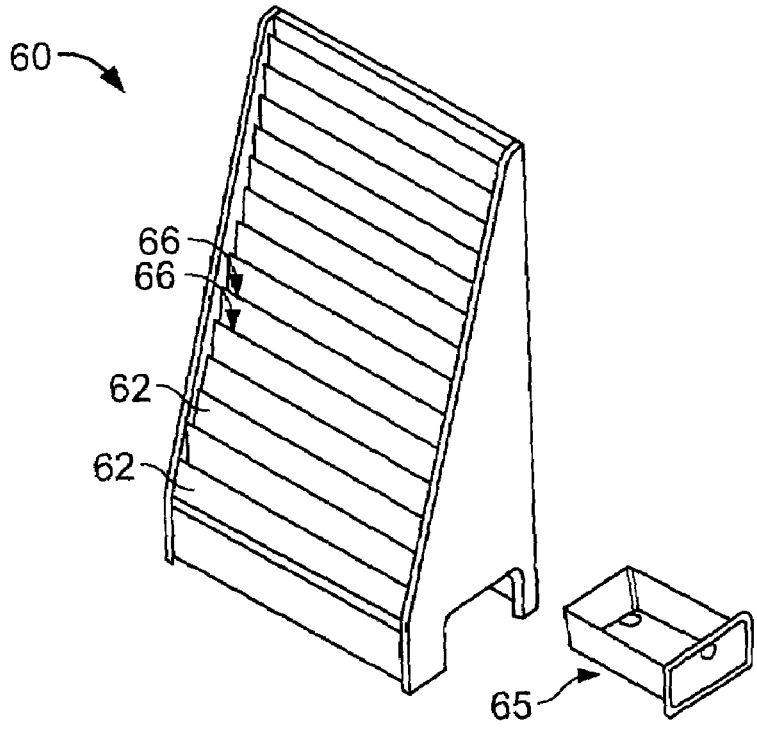
FIG. 6 is a perspective view of an end cap suitable for a display assembly according to an embodiment of the invention.

In another embodiment of the invention, an end-caps 60 may be added or abutted to a side edge 12 of display fixture 10. FIG. 6 depicts an end-cap 60 having protruding panels 62 and recesses 66 of a cascading-step pattern, similar to the previously described display panel 30. The protruding panels 62 may be translucent or transparent to permit visual inspection of items placed inside the recesses 66. Alternatively, end-cap 60 may be added for aesthetic or decorative purposes and may not include any recesses. Furthermore, the end-cap 60 may be adapted to include one or more storage drawers 65 in the base of the end-cap. Such storage drawers 65 may be used for storing excess items that will be displayed on an end-cap 65 or fixture 10 at a later time.

Figure 7:
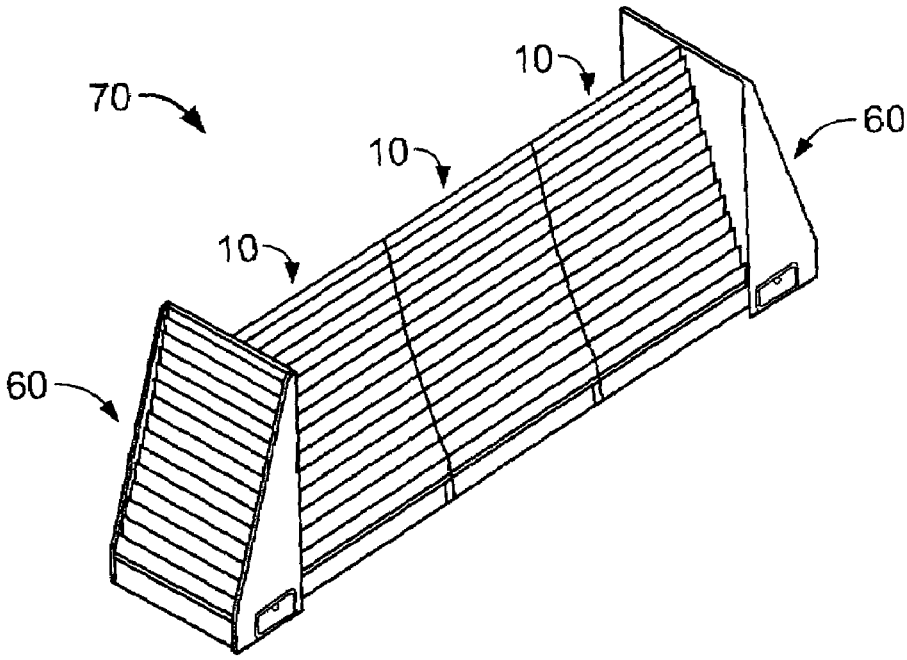
FIG. 7 is a perspective view of a display assembly according to another embodiment of the invention, connecting multiple display structures in series.

FIG. 7 depicts a display assembly 70 constructed from multiple display fixtures 10 connected together or disposed adjacently. The display fixtures 10 may be positioned side-by-side with end-caps 60 added or attached to the side edges 12 of the outer display fixtures. As shown in FIG. 7, the display assembly 70 has an external appearance that is similar in many respects to the conventional displays, but the lightweight and easily constructed display fixtures 10 have a monocoque construction so that the internal structure and appearance are quite different from typical displays.

Figure 8:
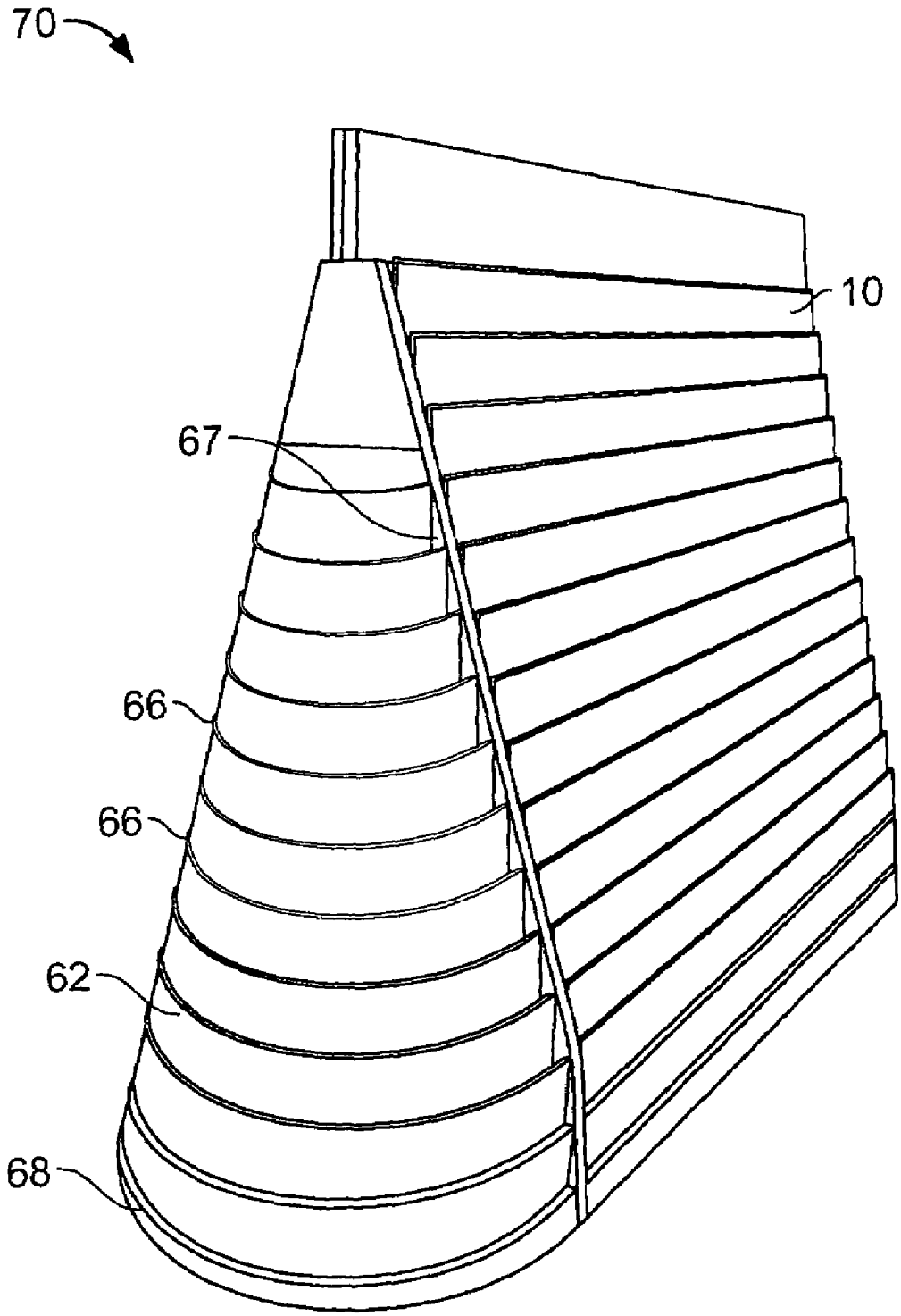
FIG. 8 is a perspective view of the display assembly of FIG. 7 in accordance with another embodiment of the invention, including another end-cap embodiment.

FIG. 8 shows another embodiment of the display assembly 70, which includes a conical end-cap 68 added or abutted to a side edge 12 of display fixture 10. The triangular back wall of the end-cap 68 may have edges 67 sloped at an angle substantially identical to the side edge 12 of the display fixture 10 so as to provide a uniform appearance. In addition, the conical end-cap 68 may have recesses 66 of a cascading-step pattern and extending panels 62 to provide a pocket that holds items to be displayed. The extending panels 62 may be translucent or transparent to permit visual inspection of items placed inside the recesses 66. Similar to end-cap 60 (FIG. 6) the conical end-cap 68 may be adapted to include one or more storage drawers.

Figure 9:
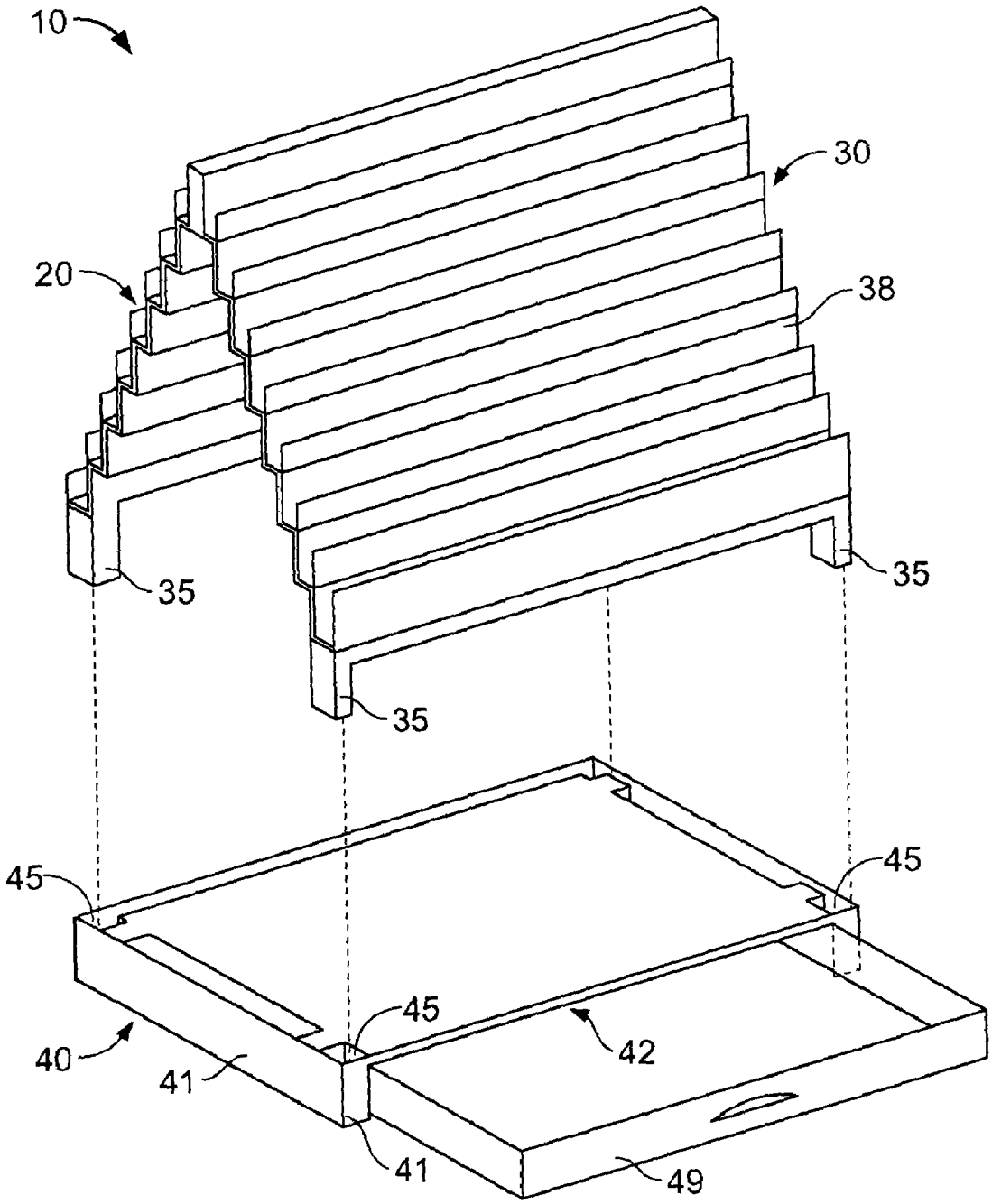
FIG. 9 is an exploded view of a display apparatus in accordance with another embodiment of the invention.

Certain embodiments of the display fixture may provide access to storage space, which could be used to store excess items that will be displayed on the fixture 10 at a later time. In one such embodiment, FIG. 9 shows a display fixture 10 with a base 40 that includes a storage drawer 49. The base 40 may have a recess 42 or similarly disposed cut-out that operates as a receptacle for storage drawer 49. The display panels 20 and 30 may have mating extensions 35 in the form of downwardly projecting tabs that contact and mate with inner surfaces 45 of the base 40, which may provide increased storage space in the central portion of the base 40 for the recess 42. The drawer 49 may be accessed by pulling the drawer 49 away from the base 40 (e.g. away from the front side 38 of the display panel 30). The base 40 may be adapted to include a plurality of drawers 49. For example, the base may include one drawer 49 that is accessed from the front side 38 of display panel 30 while a second drawer (not shown) is accessed from the front side of the opposing panel 20.

Figure 10:
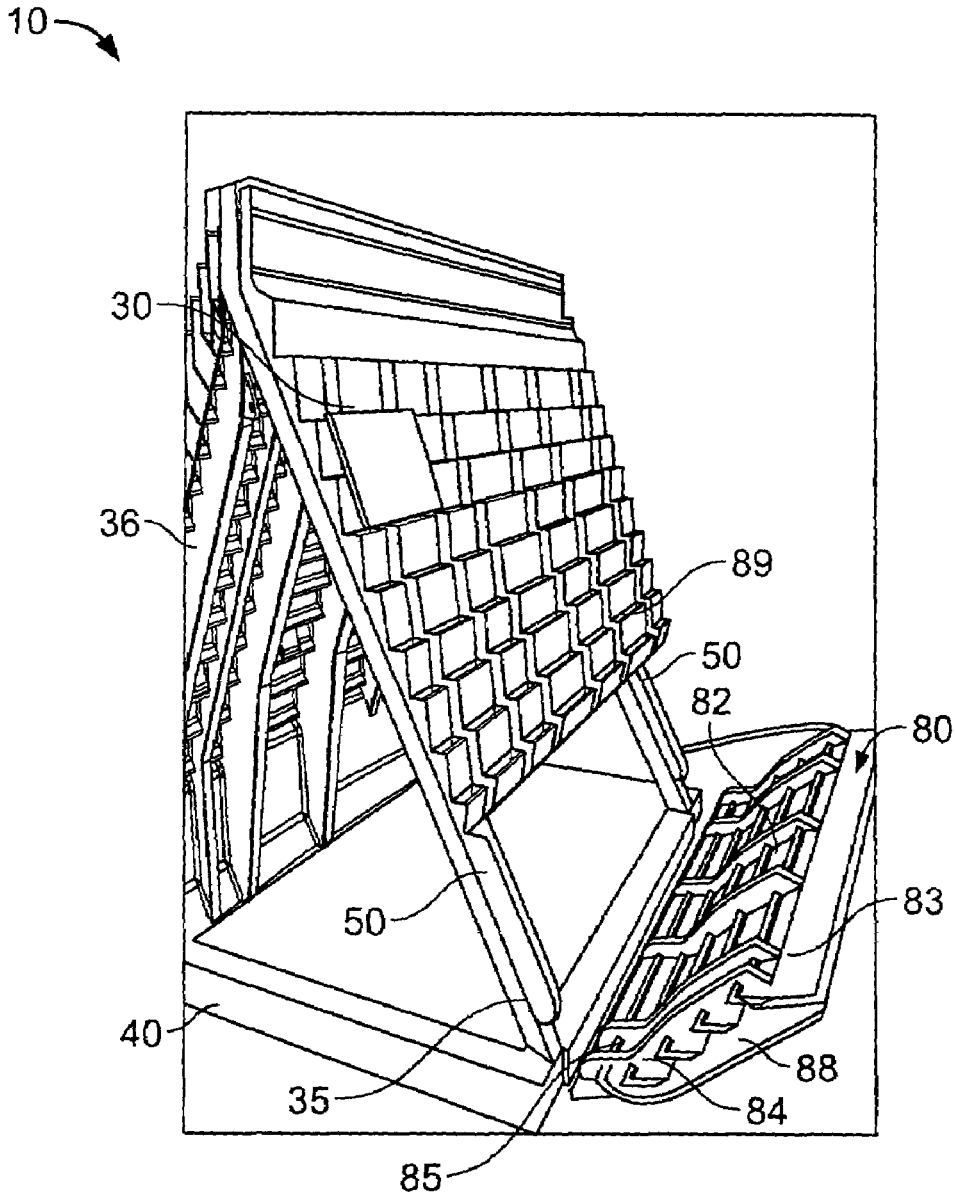
FIG. 10 is a perspective view of a display apparatus in accordance with another embodiment of the invention.

FIG. 10 shows another embodiment of a display fixture 10 that includes an access door 80 in a lower portion of the display panel 30. The display panel 30 may have rib supports 50 with mating extensions 35 in the form of downwardly projecting tabs, which mate with slots or other receptacles formed in the base 40. The lower end 84 of the access door 80 may have a mating extension 85 that also contacts and mates with the base 40. The access door 80 may be removably attached to the display panel 30 so as to provide access to the central volume of the display fixture 10. The front side 88 of the access door 80 may include recesses (not shown) to provide a uniform pattern with the recesses 36 of the display panel 30 when the door 80 is in a closed position. Because the display fixture 10 is design to have monocoque construction, the central volume of the display fixture 10 is substantially empty and may be used as storage space. In this embodiment, the back side 82 of the access door 80 is adapted to contact and mate with the rib supports 50 of the display panel 30. As such, the storage space may be accessed by pulling the upper end 83 of the access door 80 away from the rib supports 50 while the mating extension 85 of the access door remains in contact with the base 40. In doing so, the access door 80 may be swung to an open position (as shown in FIG. 10). Optionally, the mating extension 85 may be completely removed from the base 40 after the door is swung to an open position. Furthermore, the display fixture 10 may include one or more safety cables 89 to restrain the motion of the access door 80 after the door 80 is swung to an open position.

Figure 11:
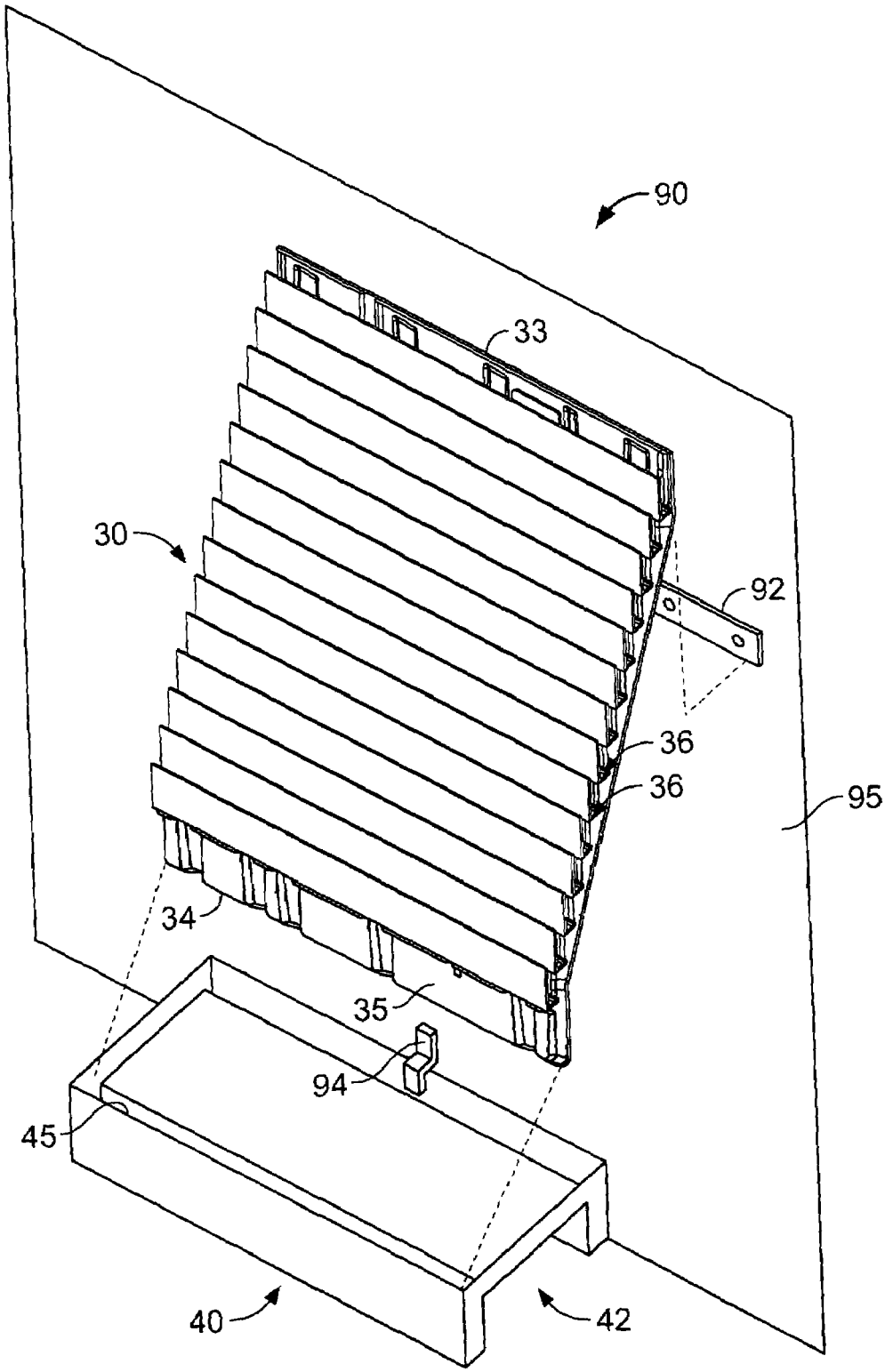
FIG. 11 is a perspective view of a display apparatus in accordance with another embodiment of the invention.

Another embodiment of the invention uses a single display panel 30 that is disposed against another support structure to provide a single-panel display fixture 90 having monocoque construction. FIG. 11 shows one embodiment of a display fixture 90 that includes a display panel 30 disposed against a substantially planar surface 95, such as a wall or a backside of a shelf. (For exemplary purposes, the surface 95 will be referred to as a wall.) The display panel 30 may be attached to the wall 95 using a conventional bracket 92 at or near the upper end 33 of the panel 30. Similarly, the base 40 may be attached to the wall 95 using an anchor bracket 94 or similar connector. The base 40 may be adapted to retain only a single panel 30 so that the mating extension 35 of the single panel 30 may contact and mate with one or more inner surfaces 45 of the base 40. When assembled as described in FIG. 11, the single-panel display fixture 90 has a monocoque construction such that no inner frame is necessary to support the display panel 30.

Figure 12:
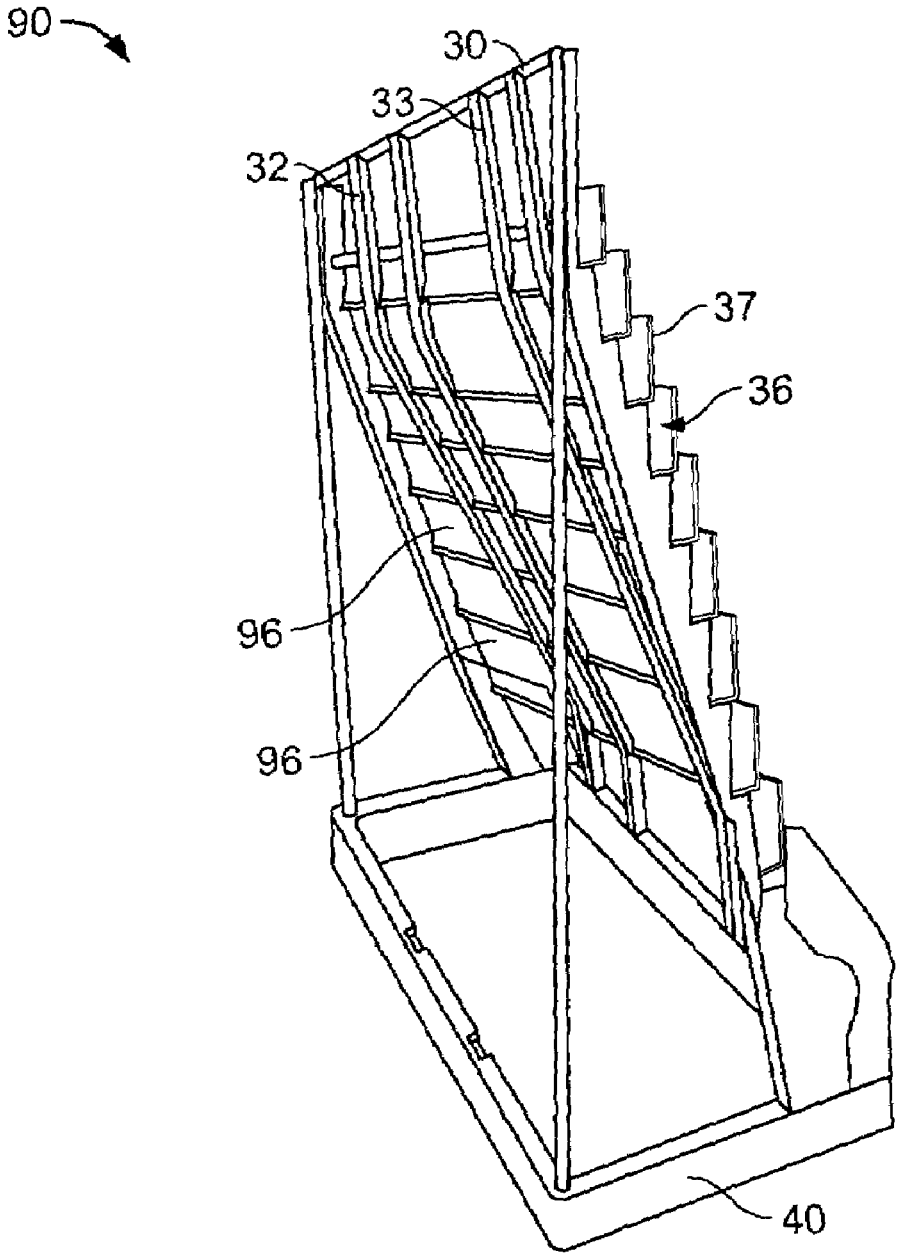
FIG. 12 is a perspective view of a display apparatus in accordance with another embodiment of the invention.

Alternatively, the single-panel display fixture may be assembled as a stand-alone structure that may be readily relocated. FIG. 12 shows one embodiment of a single-panel stand-alone display fixture 90. The mating portion (not shown in FIG. 12) of the display panel 30 contacts and mates with the base 40 in substantially the same manner shown in FIG. 11. One or more substantially rigid poles 96 extend vertically from the base 40 and are attached to the back side 32 of the display panel 30 at or near the upper end 33. The poles may be attached to the base 40 by conventional connectors or by inserting the poles 96 into corresponding slots or receptacles in the base 40. Similarly, the poles may be attached to the display panel 30 by a mechanical connector or by inserting the poles 96 into corresponding cavities formed at or near the upper end 33 of the panel 30. In this embodiment, the single-panel display fixture 90 may be moved from a first position having the back side 32 of the display panel 30 facing a wall to a second position where the back side 32 faces another wall.

The display panels and base units described above can be constructed from a variety of materials including poly-alpha-olefins such as high impact polystyrene, fiberglass, metal, and polymer composites. In preferred constructions, the panels and base unit are vacuum formed polystyrene.

Various modifications can be made to the particular embodiments described above. The base need not be used in conjunction with the panels; the panels 20 and 30 may optionally be configured to rest directly on a substrate such as a floor. In such embodiments, the lower ends of the panels can be maintained at a substantially fixed position relative to one another by use of, for example, a rigid member which spans between and connects to the lower edges of each panel. The panel can be made by conventional thermoforming techniques and in such processes the recesses may be integrally formed within the panel itself. These techniques include but are not limited to vacuum forming and rotational molding.

Any suitable means can be used to fasten the panels and base units or each other or a wall structure. Conventional fasteners, clips, and/or fastener-and-anchor assemblies. Wall affixation can be accomplished with mounting members fastened to the wall which receive with structures disposed on the back side of the panels, such as a bracket-and-rod assembly wherein the rod extends through apertures formed in the rib supports. The panels may be constructed to interlock or clip together at their upper ends so that the entire display fixture can be assembled without the use of hand tools.

The panels of the invention need not be used to display merchandise, but can instead be configured to hold other items such as miscellaneous inventories and paper goods, by way of non-limiting example. In a preferred aspect of the invention, the display fixture can be configured to hold greeting cards, notepads, and other paper goods.

A number of embodiments of the invention have been described. Nevertheless, it will be understood that various modifications may be made without departing from the spirit and scope of the invention.

What is claimed is:

1. A display apparatus, comprising:

first and second panels each having an upper edge, a lower edge, recesses extending along a front side of the panel, at least one support rib integrally formed along a back side of the panel and extending in a direction substantially perpendicular to said recesses, and at least one mating member proximal a lower edge of the panel, said panels being secured to one another proximal their upper edges and being adapted to be substantially entirely supported proximal their upper and lower edges; and a substantially rigid base member receiving said mating member of the first and second panels so as to retain the lower edges of the first and second panels a fixed distance from one another, wherein the first and second panels are substantially mutually supporting so as to form a frameless display fixture.

2. The apparatus of claim 1, wherein the mating member extends from the lower edge of the panel.

3. The apparatus of claim 1, wherein the base member comprises an integrally molded tub having a plurality of recesses adapted to receive the mating members.

4. The apparatus of claim 1, wherein the mating members are extension members adapted to be received within the base member.

5. The apparatus of claim 1, wherein at least one of the first and second panels includes two extending members that define an access portal and an access door hingedly attached to the apparatus proximate the base unit.

6. The apparatus of claim 1, wherein the recesses are adapted to receive greeting cards.

7. The apparatus of claim 1, wherein each panel is adapted to be affixed to the base member without the use of any hand tools and wherein the panels are adapted to be affixed to one another with a fastener.

8. The apparatus of claim 1, wherein each support rib has a draft angle of about 3° to about 10°.

9. The apparatus of claim 1, wherein the panels may be nested together in a stack.

10. The apparatus of claim 1, further comprising substantially transparent planar members affixed to and extending from each panel, said planar members cooperating with the recesses to define channels adapted to receive merchandise for display.

11. A display apparatus, comprising:

first and second panels each having an upper edge, a lower edge, recesses extending along a front side of the panel, at least one support rib integrally formed along a back side and extending in a direction substantially perpendicular to said recesses, and at least one mating member proximal a lower edge of the panel, said panels being secured to one another proximal their upper edges; and a substantially rigid base member receiving said mating member of the first and second panels so as to retain the lower edges of the first and second panels a fixed distance from one another, the base member comprising an integrally molded tub having a plurality of recesses adapted to receive the mating members, wherein the first and second panels are substantially mutually supporting so as to form a frameless display fixture.

12. The apparatus of claim 11, wherein the mating members are extension members that project from the lower edge of the panel and are adapted to be received by the base member.

13. The apparatus of claim 11, wherein the recesses are adapted to receive greeting cards.

14. The apparatus of claim 11, wherein each panel is adapted to be affixed to the base member without the use of any hand tools and wherein the panels are adapted to be affixed to one another with a fastener.

15. A display apparatus, comprising:

first and second panels each having an upper edge, a lower edge, recesses extending along a front side of the panel, and at least one mating member proximal a lower edge of the panel, said panels being secured to one another proximal their upper edges;

substantially transparent planar members affixed to and extending from each panel, said planar members cooperating with the recesses to define channels adapted to receive merchandise for display; and a substantially rigid base member receiving said mating member of the first and second panels so as to retain the lower edges of the first and second panels a fixed distance from one another, wherein the first and second panels are substantially mutually supporting so as to form a frameless display fixture.

16. The apparatus of claim 15, each panel further includes at least one support rib integrally formed along a back side and extending in a direction substantially perpendicular to said recesses.

17. The apparatus of claim 15, wherein the recesses are adapted to receive greeting cards.

18. The apparatus of claim 15, wherein each panel is adapted to be affixed to the base member without the use of any hand tools and wherein the panels are adapted to be affixed to one another with a fastener.

19. A display apparatus, comprising:

first and second panels each having an upper edge, a lower edge, recesses extending along a front side of the panel, and at least one mating member proximal a lower edge of the panel, said panels being secured to one another proximal their upper edges and being adapted to be substantially entirely supported proximal their upper and lower edges; and a substantially rigid base member receiving said mating member of the first and second panels so as to retain the lower edges of the first and second panels a fixed distance from one another, wherein the first and second panels are substantially mutually supporting so as to form a frameless display fixture, and wherein the panels may be nested together in a stack.

20. The apparatus of claim 19, each panel further includes at least one support rib integrally formed along a back side and extending in a direction substantially perpendicular to said recesses.

21. The apparatus of claim 20, wherein each support rib has a draft angle of about 3° to about 10°.

22. The apparatus of claim 19, wherein the mating member extends from the lower edge of the panel.

23. The apparatus of claim 19, wherein the base member comprises an integrally molded tub having a plurality of recesses adapted to receive the mating members.

24. The apparatus of claim 19, wherein the mating members are extension members adapted to be received within the base member.

25. The apparatus of claim 19, wherein at least one of the first and second panels includes two extending members that define an access portal and an access door hingedly attached to the apparatus proximate the base unit.

26. The apparatus of claim 19, wherein the recesses are adapted to receive greeting cards.

27. The apparatus of claim 19, wherein each panel is adapted to be affixed to the base member without the use of any hand tools and wherein the panels are adapted to be affixed to one another with a fastener.

28. The apparatus of claim 19, further comprising substantially transparent planar members affixed to and extending from each panel, said planar members cooperating with the recesses to define channels adapted to receive merchandise for display.

* * * * *